US009318840B2

(12) United States Patent
Siev et al.

(10) Patent No.: US 9,318,840 B2
(45) Date of Patent: Apr. 19, 2016

(54) MATCHED HIGH-SPEED INTERCONNECTOR ASSEMBLY

(71) Applicant: BELDEN CANADA INC., Saint-Laurent (CA)

(72) Inventors: Virak Siev, Montreal (CA); Francois Beauregard, La Prairie (CA); Marc Fontaine, Les Cèdres (CA)

(73) Assignee: BELDEN CANADA INC., Saint-Laurent (CA)

( * ) Notice: Subject to any disclaimer, the term of this patent is extended or adjusted under 35 U.S.C. 154(b) by 228 days.

(21) Appl. No.: 13/930,847

(22) Filed: Jun. 28, 2013

(65) Prior Publication Data

US 2014/0011403 A1 Jan. 9, 2014

Related U.S. Application Data

(60) Provisional application No. 61/665,435, filed on Jun. 28, 2012.

(51) Int. Cl.

| | |
|---|---|
| ***H01R 24/00*** | (2011.01) |
| ***H01R 13/58*** | (2006.01) |
| ***H01R 13/6466*** | (2011.01) |
| ***H01R 24/64*** | (2011.01) |

(52) U.S. Cl.

CPC ..... *H01R 13/582* (2013.01); *H01R 13/6466* (2013.01); *H01R 24/64* (2013.01)

(58) Field of Classification Search

USPC ..... 439/676, 941

IPC . H01R 23/025,23/005, 23/6658; H05K 1/0028, H05K 2201/1018

See application file for complete search history.

(56) References Cited

U.S. PATENT DOCUMENTS

| | | | | |
|---|---|---|---|---|
| 4,811,165 | A * | 3/1989 | Currier et al. | 361/716 |
| RE38,519 | E * | 5/2004 | Doorhy et al. | 439/404 |
| 7,837,513 | B2 * | 11/2010 | Millette et al. | 439/676 |
| 7,905,753 | B2 * | 3/2011 | Siev et al. | 439/638 |
| 8,993,887 | B2 * | 3/2015 | Parham et al. | 174/81 |
| 2002/0177369 | A1 * | 11/2002 | Hyland | 439/676 |
| 2010/0159752 | A1 | 6/2010 | Siev et al. | |
| 2010/0190366 | A1 | 7/2010 | Fitzpatrick | |

OTHER PUBLICATIONS

International Search Report and Written Opinion for PCT/CA2013/050508, Oct. 10, 2013.

* cited by examiner

*Primary Examiner* — Hien Vu

(74) *Attorney, Agent, or Firm* — Goudreau Gage Dubuc; Hugh Manfield

(57) ABSTRACT

An assembly for use in a system comprising a plurality of pairs of conductors, and a plug/receptacle for terminating the cable at a rear end thereof, a plurality of evenly spaced terminal contacts/tines respectively exposed along a front of the plug body/within the receptacle, arranged in parallel, and a printed circuit board assembly comprising a plurality of pairs of traces interconnecting each conductor of the pairs of conductors with respective ones of the terminal contacts/tines. A center pair of the conductors is attached to a first pair of the terminal contacts/tines and a second pair of conductors is attached to a second pair of the terminal contacts/tines. The center pair of terminal contacts/tines is positioned between the second pair of contacts/tines wherein in operation a current flow in the center pair of terminal contacts/tines is in a direction substantially away from the second pair of terminal contacts/tines.

5 Claims, 17 Drawing Sheets

MATCHED HIGH-SPEED INTERCONNECTOR ASSEMBLY

BACKGROUND TO RELATED APPLICATIONS

This application claims benefit, under 35 U.S.C. §119(e), of U.S. provisional application Ser. No. 61/665,435, filed on Jun. 28, 2012 and Canadian Application No. 2,782,486 also filed on Jun. 28, 2012. All documents above are incorporated herein in their entirety by reference.

FIELD OF THE INVENTION

The present invention relates to a matched high-speed interconnector assembly. In particular, the present invention relates to a matched plug and receptacle pair comprising a compensation which allows either the high-speed plug or the high-speed receptacle to form part of a legacy network.

BACKGROUND TO THE INVENTION

Many prior art plug and connector systems based on the ubiquitous RJ-45 standard suffer from the limitation that in order to correctly mate plug and connector, the pair comprised of conductors 3 and 6 is separated by the pair comprised of conductors 4 and 5. This means that the pairs introduce small areas of reactive coupling that, at higher frequencies, degrade the resultant connection. As a result, such prior art plug and connector systems are typically unsuitable for use at higher data rates.

Prior art systems have addressed the above drawback by reorganizing the connectors such that such reactive coupling can be avoided. However, the resultant plugs and connectors of such systems are not backwardly compatible, and an adaptor or the like must be used to achieve compatibility with legacy plugs and connectors.

SUMMARY OF THE INVENTION

In order to address the above and other drawbacks, there is provided a cable assembly for use with a receptacle comprising a plurality of evenly spaced tines in a telecommunications system. The cable assembly comprises a cable comprising a plurality of pairs of conductors, and a RJ-45 style plug comprising a plug body for terminating the cable at a rear end thereof, a plurality evenly spaced terminal contacts exposed along a front of the plug body and arranged in parallel, and a printed circuit board assembly comprising a plurality of pairs of conductive traces interconnecting each conductor of the pairs of conductors with respective ones of the terminal contacts, wherein a first pair of the pairs of conductors is interconnected with respective ones of a center pair of the terminal contacts and a second of the pairs of conductors is interconnected with respective ones of a second pair of the terminal contacts, the center pair of terminal contacts positioned between and immediately adjacent to the second pair of contacts. When the plug is inserted into the receptacle, each of the plurality of terminal contacts comes into contact with a respective one of the plurality of tines along a contact region and further wherein each of the terminal contacts is interconnected with a respective trace such that a current flow between the plug and the receptacle in the center pair of terminal contacts is in a direction substantially away from that of the second pair of terminal contacts.

There is also provided a receptacle assembly for receiving a plug comprising a plurality of evenly spaced terminal contacts in a telecommunications system. The receptacle assembly comprises a plurality of pairs of conductors, and a RJ-45 style receptacle comprising a receptacle housing for terminating the plurality of pairs of conductors at a rear end thereof, plurality of evenly spaced tines exposed within the receptacle housing and arranged in parallel and a printed circuit board assembly comprising a plurality of pairs of traces interconnecting each conductor of the plurality of pairs of conductors with respective ones of the plurality of tines, wherein a first pair of the pairs of conductors is interconnected with respective ones of a center pair of the tines and a second pair of the pairs of conductors is interconnected with respective ones of a second pair of the tines, the center pair of tines positioned between and immediately adjacent to the second pair of tines. When the plug is inserted into the receptacle, each of the plurality of terminal contacts comes into contact with a respective one of the plurality of tines along a contact region and further wherein each of the tines is interconnected with a respective trace such that a current flow between the plug and the receptacle in the center pair of tines is in a direction substantially away from that of the second pair of tines.

Also, there is provided a circuit board for use in a telecommunications connector. The circuit board comprises an elongate flexible substrate, four pairs of elongate conductive contacts arranged side by side and in parallel to the flexible substrate on a surface of the flexible substrate, each of the contact pads comprising a first end positioned towards a first end of the flexible substrate and a second end positioned towards a second end of the flexible substrate, and a plurality of pairs of traces, one of the pairs traces interconnecting each of the pairs of elongate contacts with a respective pair of contact pads, wherein a first pair of the traces are interconnected to respective first ends of a center pair of the contacts and a second pair of the traces are interconnected to respective second ends of a second pair of the contacts, each of the second pair of contacts on opposite sides of and immediately adjacent to the center pair of contacts.

There is also provided a receptacle assembly for use in a telecommunications system. The receptacle comprises four pairs of conductors, and a RJ-45 style receptacle comprising a receptacle housing for terminating the cable at a rear end thereof, eight evenly spaced tines exposed within the receptacle housing and arranged in parallel and a printed circuit board assembly comprising a plurality of pairs of traces interconnecting each conductor of the pairs of conductors with respective ones of the tines, wherein a first pair of the four pairs of conductors is attached to a first pair of the traces towards an end of a first layer of the printed circuit board assembly and the remaining pairs of conductors are attached to their respective pairs of traces towards an end of a second layer of the printed circuit board assembly.

Additionally, there is disclosed a circuit board for use in a telecommunications connector. The circuit board comprises an elongate flexible substrate, four pairs of elongate conductive contacts arranged side by side and in parallel to the flexible substrate on a surface of the flexible substrate, and a plurality of pairs of traces, one of the pairs traces interconnecting each of the pairs of elongate contacts with a respective pair of contact pads, wherein a first of the pairs of contact pads is positioned towards a first end of the elongate flexible substrate and the remaining pairs of contact pads are positioned towards an opposite end of the elongate flexible substrate.

DETAILED DESCRIPTION OF THE ILLUSTRATIVE EMBODIMENTS

Figure 1:
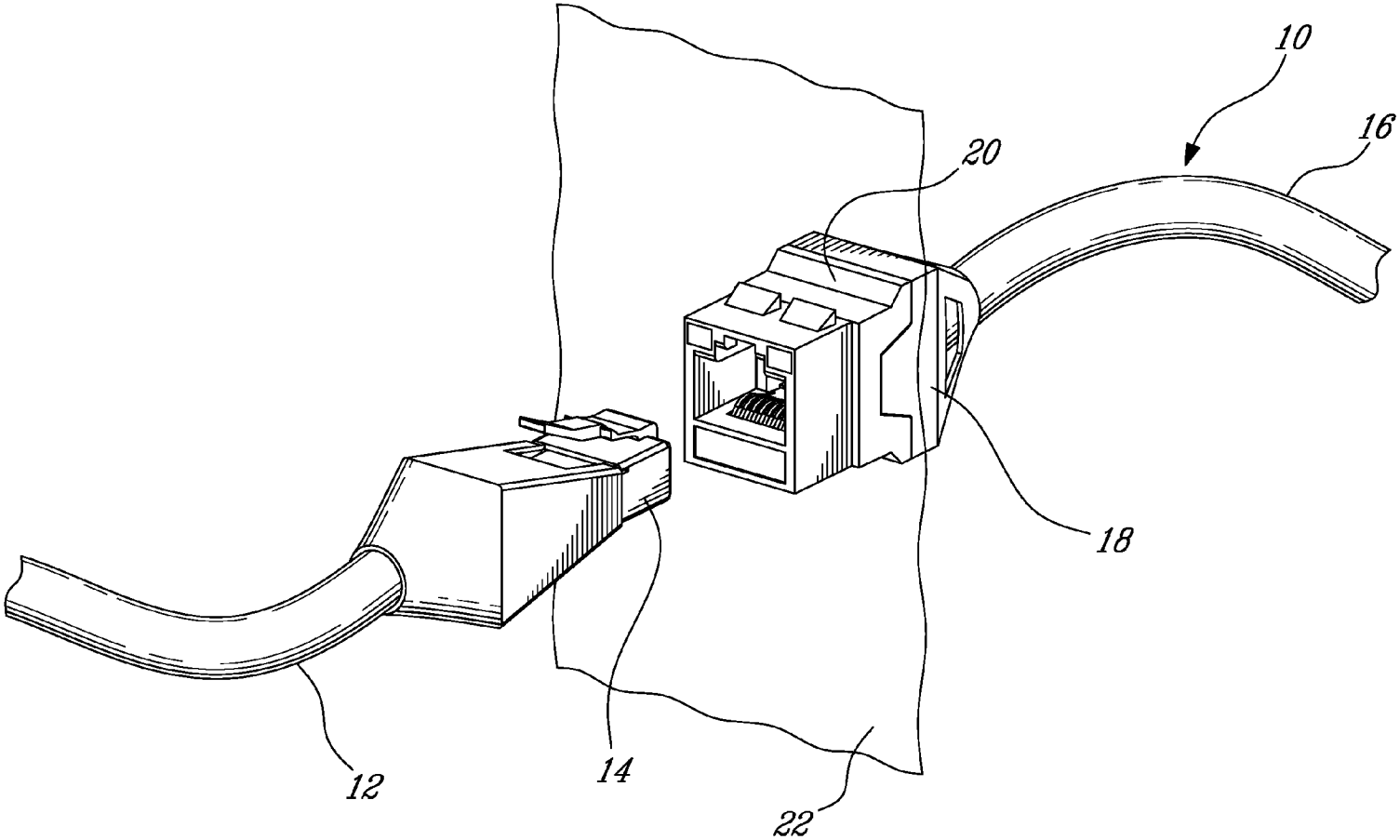
FIG. 1 is right front perspective view of a high speed interconnection assembly in accordance with an illustrative embodiment of the present invention.

Referring now to FIG. 1, a matched high speed interconnection assembly, generally referred to using the reference numeral 10, will now be described. The assembly 10 comprises a first cable 12 terminated by a plug 14 which is interconnected with a second cable 16 terminated by a receptacle 18. The plug 14 and receptacle 18 are compatible with the plug 14 configured for insertion into the receptacle 18. Illustratively, the plug 14 and receptacle 18 conform to the RJ-45 standard. The receptacle 18 is illustratively modular and comprising a keystone type housing 20 such that the receptacle 18, or typically a plurality of such receptacles, can be mounted within a keystone type wall plate 22, patch panel (not shown) or the like. Illustratively, the cables 12, 16 comprise four (4) twisted pairs of conductors (not shown) respectively terminated by the plug 14 and receptacle 18 such that when the plug 14 is mated with the receptacle 18, each of the conductors of the twisted pairs of the first cable 12 are brought into electrical contact with a respective one of the conductors of the second cable 16.

Figure 2A:
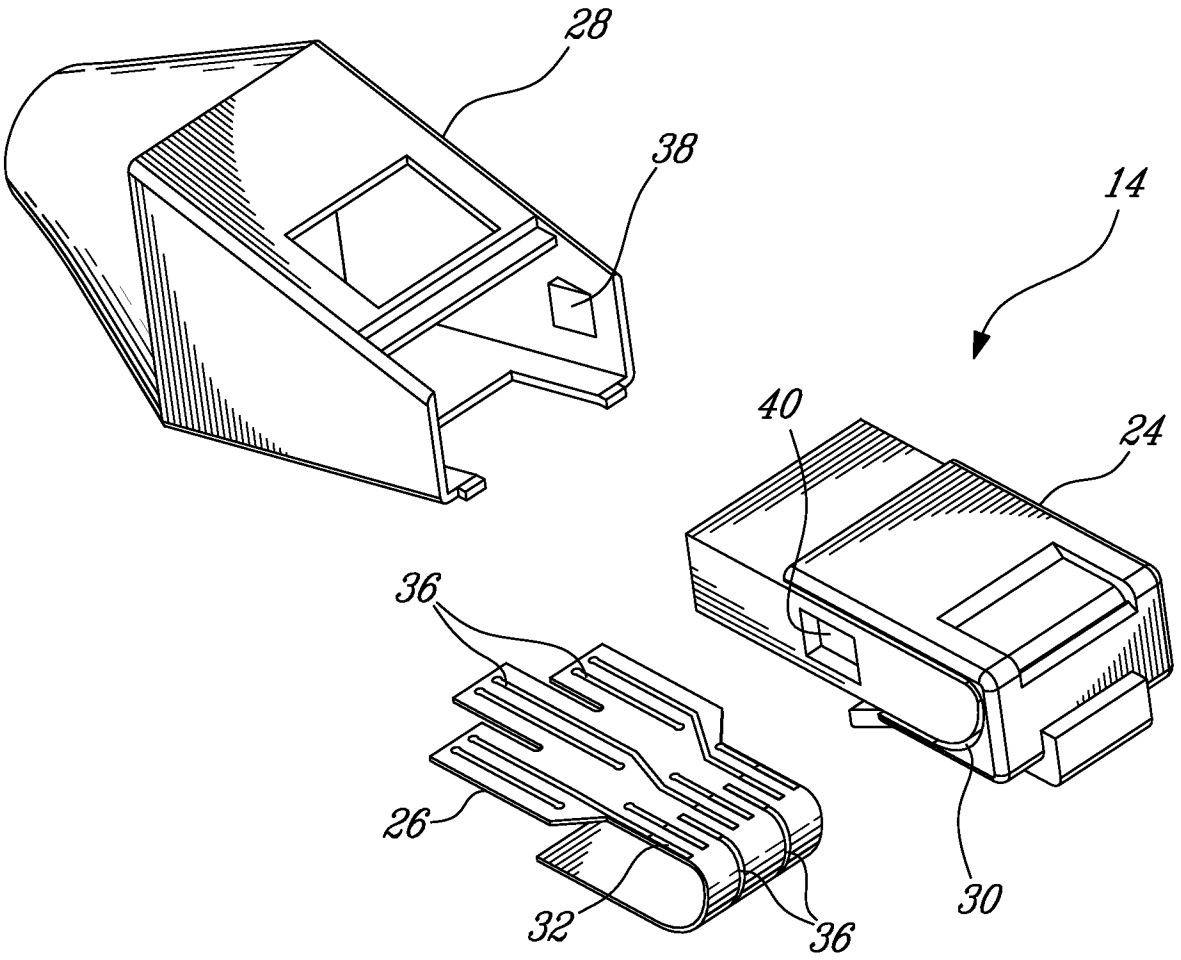
FIGS. 2*a* and 2*b* provide exploded and partially assembled perspective views of a plug in accordance with an illustrative embodiment of the present invention.

Referring now to FIG. 2*a*, the plug 14 (referred to also as the CAT8 plug) comprises a moulded plug body 24, a flexible printed circuit board (PCB) 26 and a strain relieving cuff 28. During assembly, the flexible PCB 26 is bent as shown and inserted into a slot 30 formed in the plug body 24 such that, and with reference to FIG. 2*b* in addition to FIG. 2*a*, a plurality of terminal contacts 32 are exposed along the bottom towards the front edge 34 of the plug 14. As will be discussed in more detail below, the flexible PCB 26 comprises a plurality of conductive traces as in 36 etched on the surfaces there of which are used to interconnect the individual conductors of the twisted pairs (not shown), with their respective terminal contact as in 32. Following insertion of the flexible PCB 26 into the slot 30 and interconnection of the twisted pair conductors with their respective terminal contacts 32 via the conductive traces as in 36, the strain relieving cuff 28 is slid over and secured to the plug body by a pair of raised tabs as 38 and their respective tab receiving slots 40.

Figure 3A:
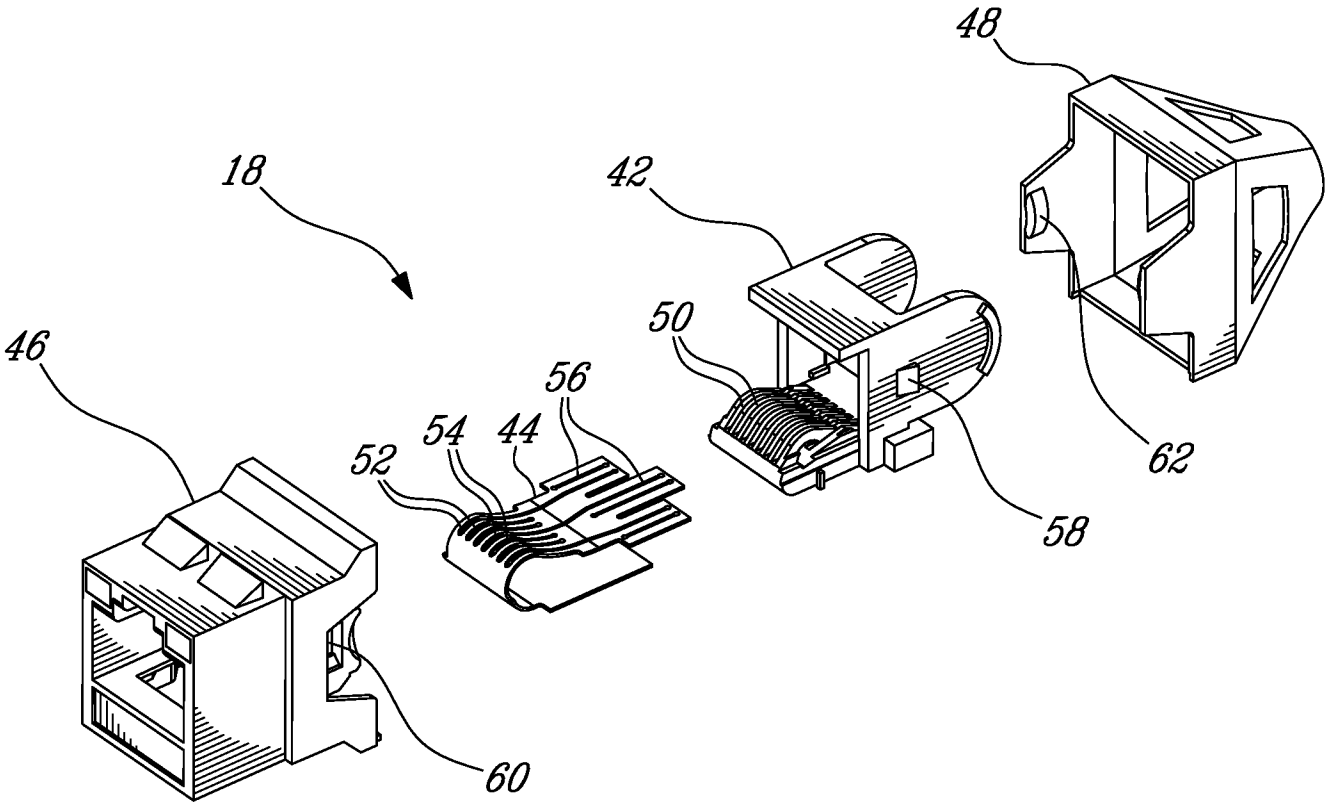
FIGS. 3*a* and 3*b* provide exploded and partially assembled perspective views of a receptacle in accordance with an illustrative embodiment of the present invention.
Figure 3B:
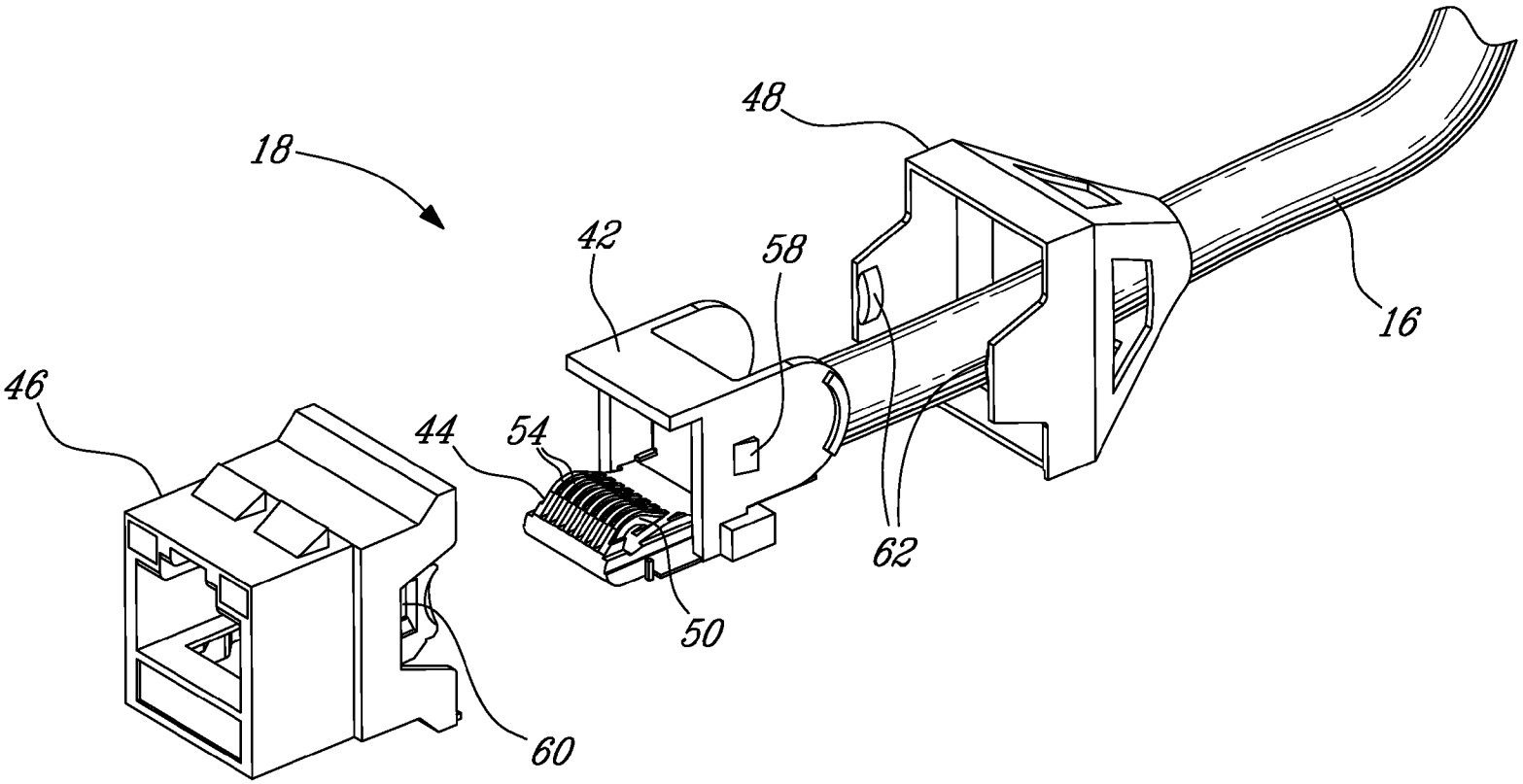

Referring now to FIG. 3*a*, the receptacle 18 (referred to also as the CAT8 receptacle) comprises a moulded receptacle support body 42, a flexible printed circuit board (PCB) 44 and a receptacle housing comprising a forward housing part 46 and a rearward housing part 48 which also serves as a cable strain relieving cuff. The receptacle support body 42 comprises a plurality of flexible curved supporting fingers 50. Illustratively, a plurality of slots 52 are formed in the flexible PCB 44 such that the portions of the flexible PCB 44 remaining between slots 52 (the tines 54) are able to flex independently of one another. During assembly the flexible PCB 44 is folded over the support body 42, and with reference to FIG. 3*b* in addition to FIG. 3*a*, each of the tines 54 are supported by a respective one of the supporting fingers 50 which introduces a slight curved shape into each of the tines 54. As will be discussed in more detail below, the flexible PCB 44 comprises a plurality of conductive traces as in 56 etched on the surfaces there of which are used to interconnect the individual conductors of the twisted pairs (not shown), with their respective tines as in 54. Following folding of the flexible PCB 44 over the support body and interconnection of the twisted pair conductors with their respective tines 54 via the conductive traces 56, the assembly is inserted into the forward housing part 46. A pair of tabs 58 moulded in the support body 42 are secured in a pair of complementary slots 60 on the forward housing part 46. The rearward housing part 48 is then secured over the flexible PCB 44/support body 42 assembly by inserting a pair of tabs 62 moulded in the rearward housing part 48 into the same pair of complementary slots 60 on the forward housing part 46.

Figure 4A:
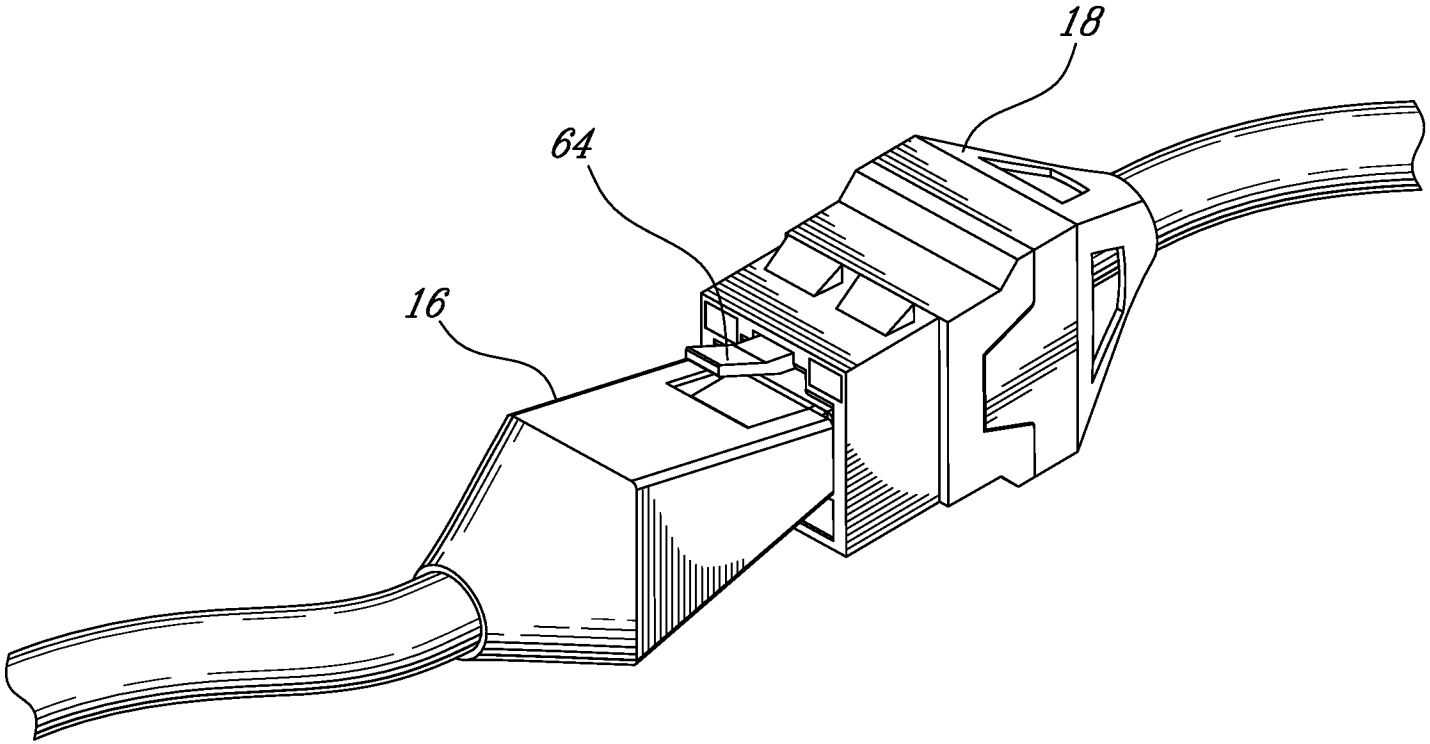
FIG. 4*a* illustrates a plug inserted into a receptacle in accordance with an illustrative embodiment of the present invention.
Figure 4B:
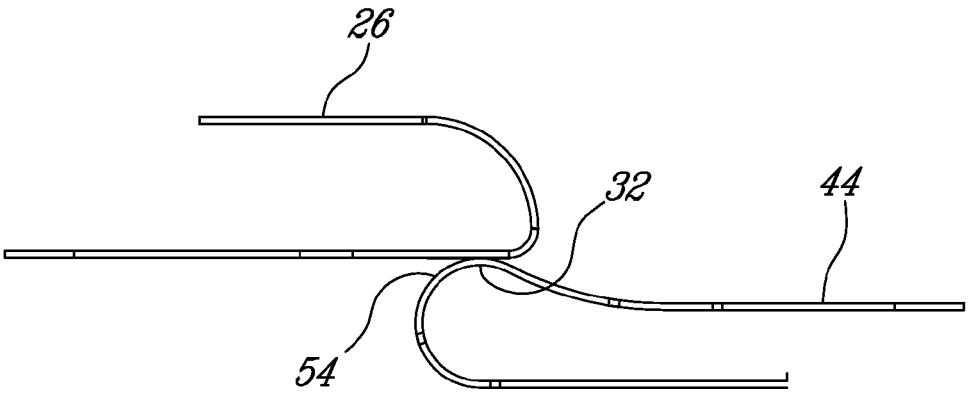
FIGS. 4*b* and 4*c* provide respectively a plan view and a perspective view of the interconnection between the flexible printed circuit boards and in accordance with an illustrative embodiment of the present invention.
Figure 4C:
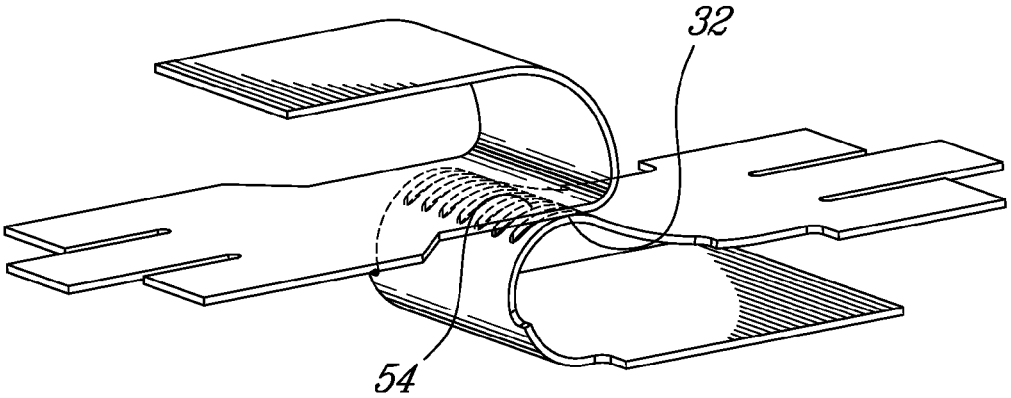

Referring now to FIG. 4*a*, in use the plug 14 is inserted into the receptacle 18 such that a securing tab 64 on the plug 14 is engaged. Referring now to FIGS. 4*b* and 4*c*, this brings each terminal contact as in 32 into contact with their respective tine as in 54 thereby completing the interconnection via the traces 36, 56 between respective ones of the twisted pair conductors. The curvature of the tines as in 54 and the countering force generated by the flexible support fingers (reference 50 in FIG. 3*a*) ensure that the tines 54 remain in contact with their respective terminal contacts as in 32.

Figure 2B:
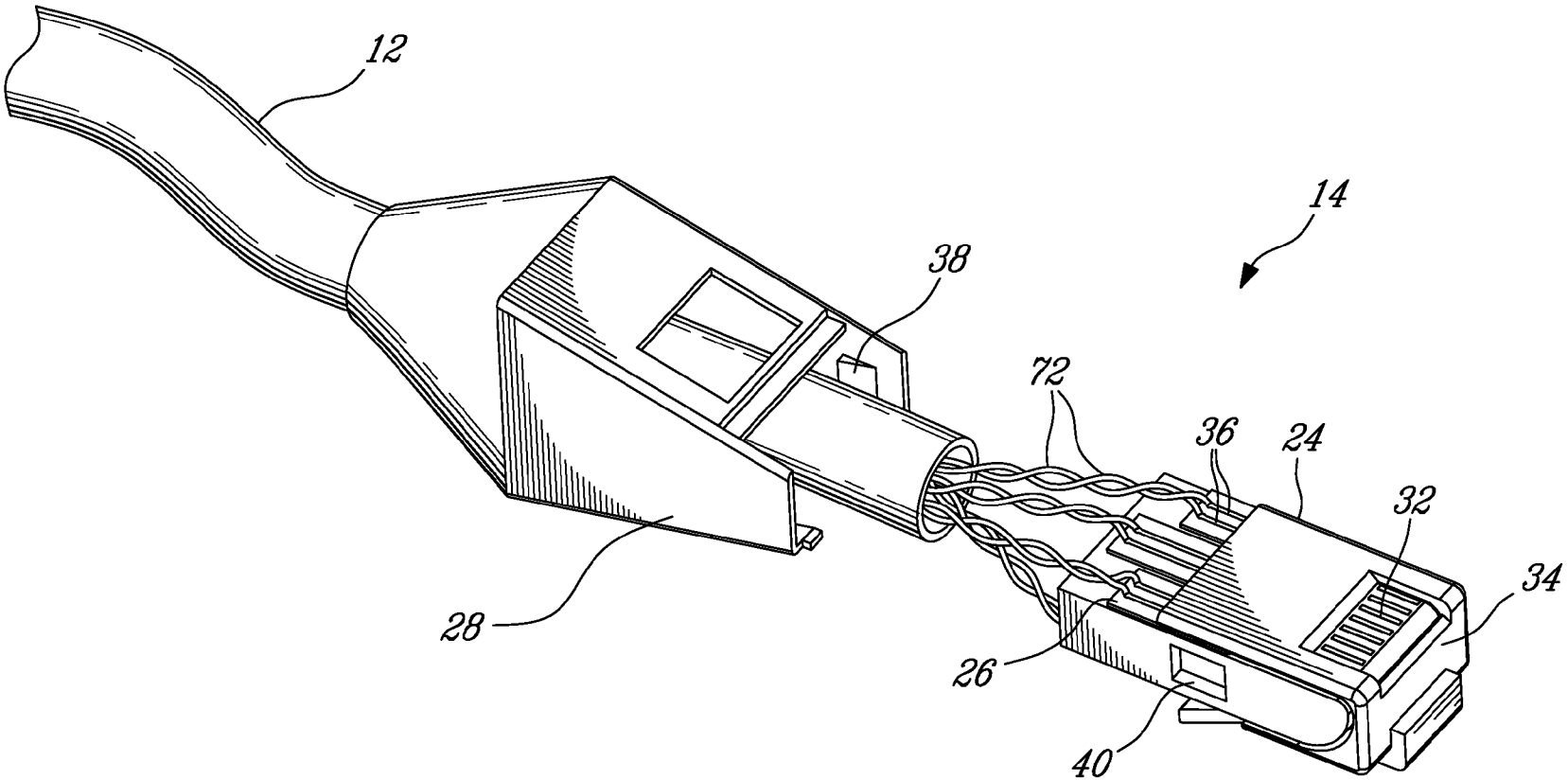
Figure 5B:
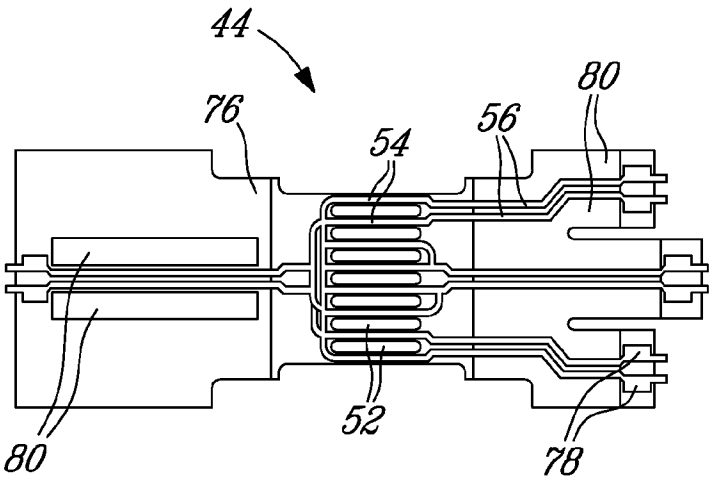
FIGS. 5*a* and 5*b* provide combined plan and perspective views of the flexible printed circuit board of respectively a plug and a receptacle in accordance with an illustrative embodiment of the present invention.
Figure 5B:
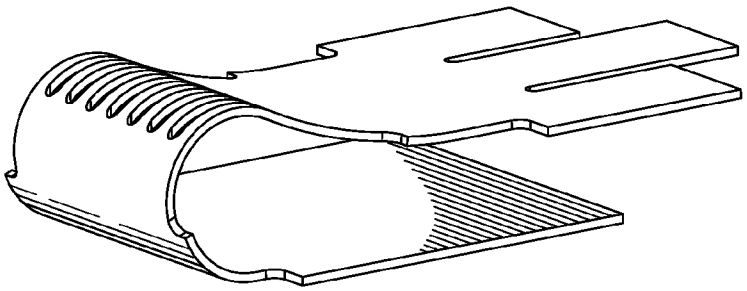
Figure 5A:
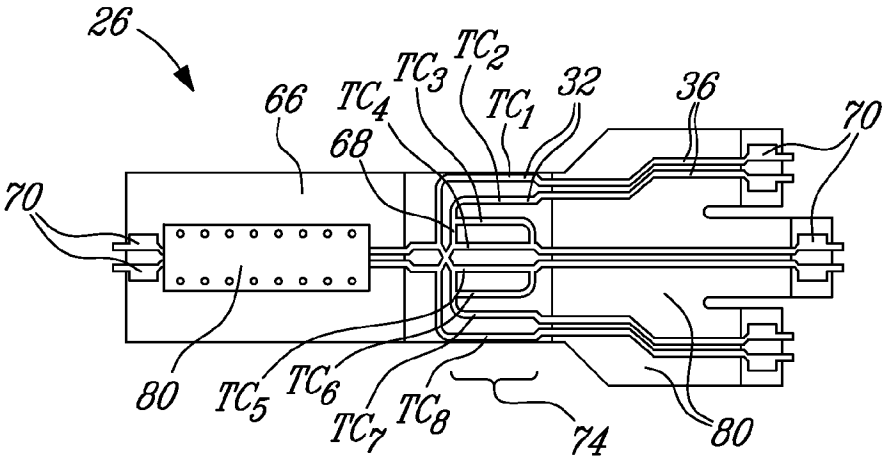
Figure 5A:
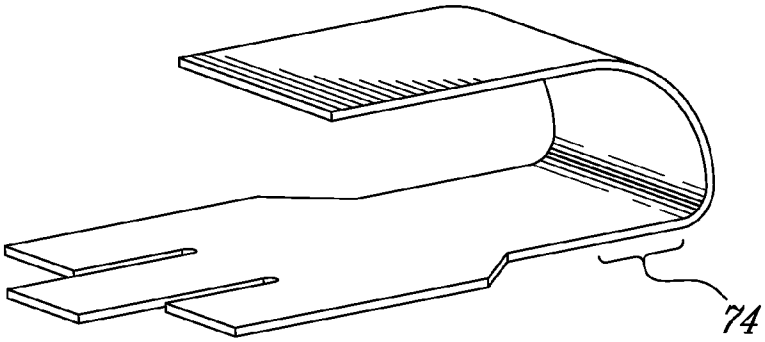

Referring now to FIG. 5*a* in addition to FIG. 2*b*, as discussed above the flexible PCB 26 as used within the plug 14 comprise a plurality of traces as in 36 etched or otherwise formed on both surfaces of a dielectric substrate 66, the compensation layer artwork on a first surface and the contact layer artwork on a second surface. A flexible PCB is described in U.S. Pat. No. 7,837,513 for a Telecommunications Connector by Millette et al. which is incorporated herein by reference in its entirely. Indeed, traces as in 36 on a first side of the board are interconnected with traces as in 36 on an opposite side of the dielectric substrate by a Vertical Interception Access (VIA) as in 68, which provides a conductive path between surfaces of the dielectric substrate 66. A contact pad 70 is provided at an end of each conductive path and is suitable for attachment to a respective conductor as in 72 of the twisted pairs of conductors, typically by means of a piercing contact of the like (not shown). As discussed above, the terminal contacts as in 32 are positioned such that when the flexible PCB 26 is folded/curved and inserted into the slot 30 formed in the plug body 24, the terminal contacts 32 are exposed within a region 74 along the bottom towards the front edge 34 of the plug 14. Additionally, as will be discussed in more detail below, additional conductive traces as in 36 act as conductive plates and the dielectric substrate 66 as dielectric for a plurality of capacitive elements in a compensation network.

Figure 5C:
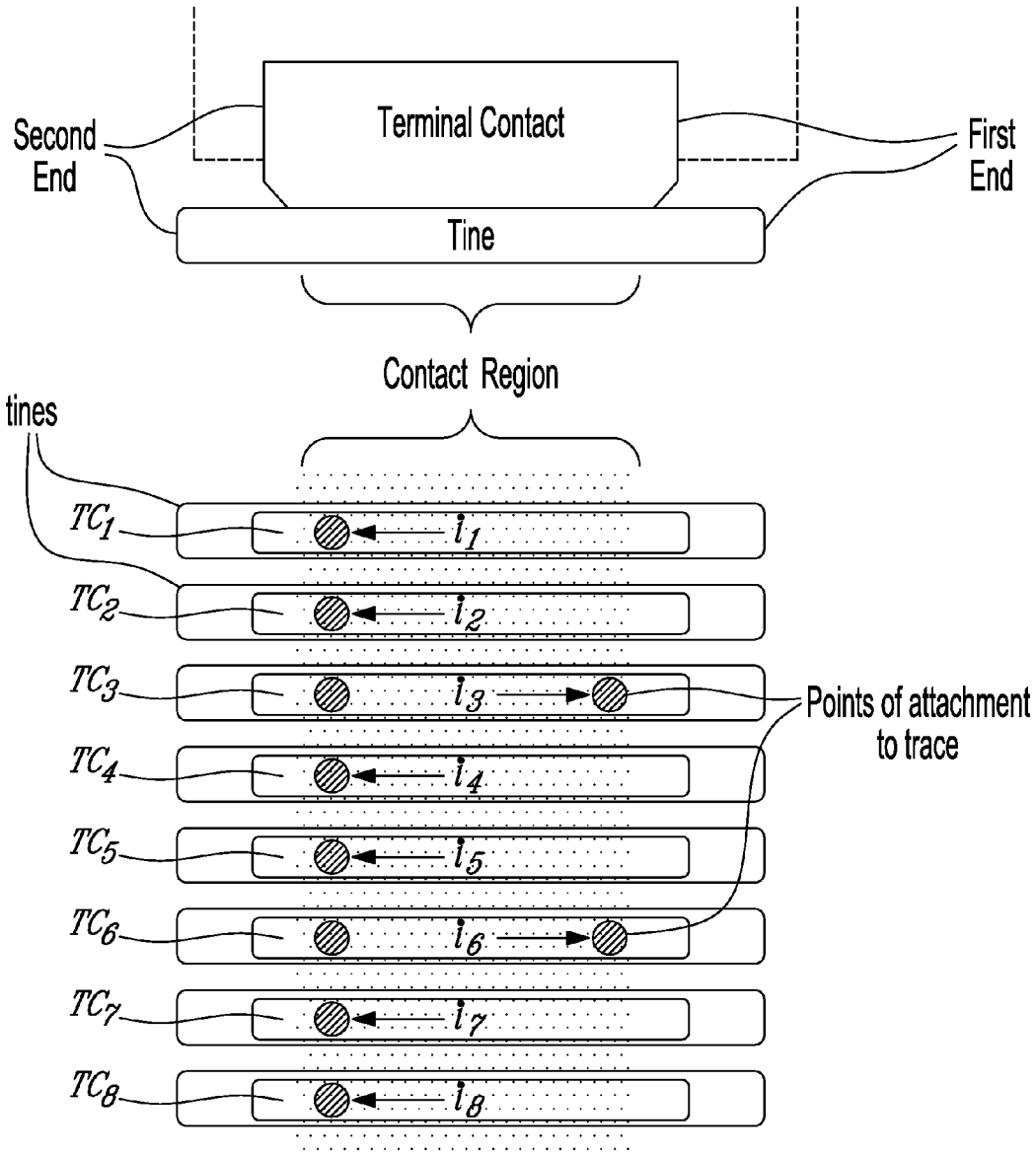
FIG. 5*c* is a schematic diagram of a contact/tine interconnection in accordance with an illustrative embodiment of the present invention.

With reference to FIG. 5*c* in addition to FIG. 5*a*, one advantage of the above configuration is that terminal contacts 3-6 ($TC_3$ & $TC_6$) are interconnected with their respective twisted pair of conductors via their respective traces and a points of attachment toward one end of the terminal contacts while terminal contacts 4-5 ($TC_4$ & $TC_6$) are interconnected with their respective twisted pairs of conductors via their respective traces and a point of attachment towards opposite ends of their respective terminal contacts. Terminal contacts 1-2 ($TC_1$ & $TC_2$) and 7-8 ($TC_7$ and $TC_8$) are illustratively shown interconnected towards the same end as terminal contacts 4-5, but in an alternative embodiment one pair of terminal contacts 1-2 and 7-8 could be interconnected as terminal contacts 3-6, or both. As illustrated in FIG. 5*c*, current flow $i_3$, $i_6$ in terminal contacts 3-6 is therefore opposite to the current flow $i_4$, $i_5$ in terminal contacts 4-5. Inductive coupling is largely removed leaving a compensating structure which, at the frequencies of interest, is dominated by capacitive reactances which provides for simplified and improved compensating at higher frequencies.

Still referring to FIG. 5*c*, of note is that although a given trace is typically interconnected to the terminal contact/tine at the end thereof, in particular embodiment the trace could be interconnected at some other point, typically towards one or other edges of the contact region such that current flows as discussed above. Also, in an additional particular embodiment the trace could be interconnected to the terminal contact/tine through the PCB using a via or the like.

Referring back to FIG. 1, as discussed above it is foreseen that a plug 14 comprising the flexible PCB 26 of FIG. 5*a* is configured to interconnect with a complementary receptacle 18 comprising a second flexible PCB (reference 44 in FIG. 5*b*). Indeed, as will be discussed below, in order to achieve the preferred compensation, the plug 14 and receptacle 18 illustratively each provide only a portion of the components necessary to achieve the high speed connector of the present invention. The components of the plug 14 and receptacle 18 therefore work together to achieve the high speed connector of the present invention.

Referring now to FIG. 5*b* in addition to FIG. 3*a*, the second flexible PCB 44 is comprised of a plurality of traces as in 56 etched or otherwise formed on the surface of a flexible dielectric substrate 76, the compensation layer artwork on a first surface and the contact layer artwork on a second surface. The traces 56 interconnect a plurality of contact pads as in 78 with their respective tines as in 54. Similar to the plug, additional conductive traces as in 56 act as conductive plates and the dielectric substrate 76 as dielectric for a plurality of reactive elements which serve as capacitive elements in a compensation network. As discussed above, in an embodiment, slots as in 52 can be punched or otherwise formed in the dielectric substrate 76 in order to allow the tines as in 54 to flex independently when, as will be seen below, the come into contact with their respective terminal contacts 32 of the plug 14. Referring again to 5*c* in addition to FIG. 5*b*, illustratively each of the tines as in 54 is connected to its respective contact pad as in 78 via a trace 56 and a point of attachment. In particular, tines 3-6 comprise a point of attachment towards one end thereof while tines 4-5 comprise a point of attachment towards an end opposite to that of the tines 1-2. Again as illustrated in FIG. 5*c*, current flow in tines 3-6 is therefore opposite to that in tines 4-5. Inductive coupling is largely removed leaving a compensating structure which, at the frequencies of interest, is dominated by capacitive reactances which provides for simplified and improved compensating at higher frequencies.

Referring back to FIG. 5*a* in addition to FIG. 5*b*, in an alternative embodiment ground plates as in 80 etched on the surface of the flexible PCB 26, 44 and connected to a ground (not shown). The ground plates 80 provide a stable and uniform reference level vis-à-vis the pair of traces as in 36 which are connected to each twisted pair of conductors. Use of a plate 80 in this manner allows a ground to be established and controlled, which in turn provides for better control of common mode impedance, which is a result of the separation between the pairs of traces as in 28. Referring back to FIG. 1, the ground can be provided, for example, by manufacturing the housing of the plug 14 and receptacle 18 from a conductive material such as metal and providing a suitably grounded faceplate 22 into which the receptacle 18, for example, is inserted.

Referring back to FIGS. 2*a* and 2*b*, note that although the above illustrative embodiment has been described in part through the advantageous use of a flexible PCB, in an alternative embodiment of the plug 14, the flexible PCB could be replaced with a rigid multilayer PCB with appropriate modifications to the plug body 24. Note also that, although the terminal contacts as in 32 and the tines as 54 are shown as conductive traces etched onto the surface of their respective flexible PCBs 26, 44, in an alternative embodiment the terminal contacts as in 32 and/or the tines as 54 could be additionally plated, for example with nickel or gold or the like, to improve their wear resistance, electrical conduction or the like or additional conductive members (not shown) could be soldered or otherwise attached to the terminal contacts as in 32 and/or the tines as in 54 in an electrically conductive manner.

Figure 6:
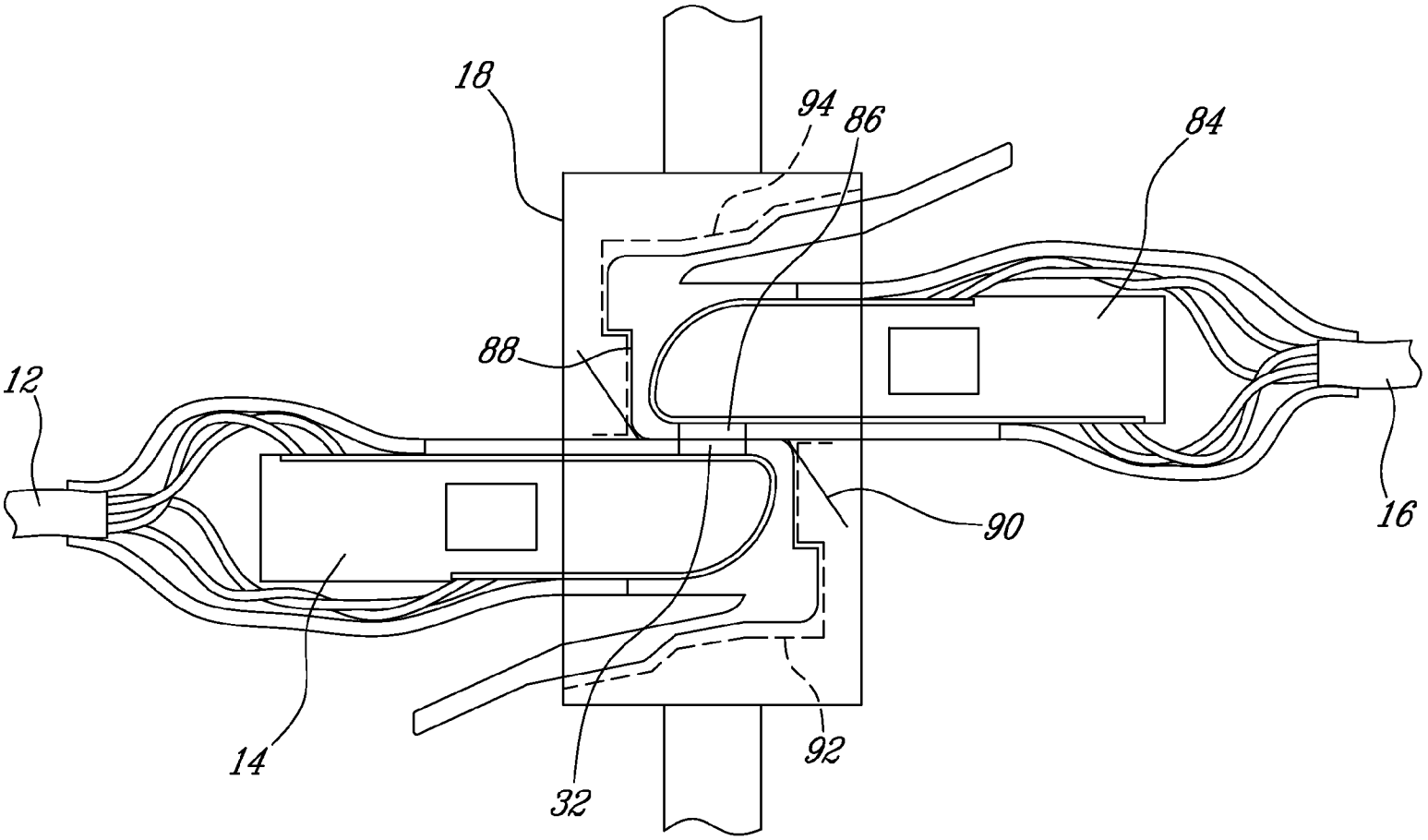
FIG. 6 illustrates a plug inserted into a receptacle in accordance with an alternative illustrative embodiment of the present invention.

Referring now to FIG. 6 in addition to FIG. 5*b*, given the complementary nature of the first flexible PCB 26 and the second flexible PCB 44 and in order to simplify the connection between the plug 14 and receptacle 18, in an alternative embodiment the second flexible PCB 44 is used to terminate the second cable 16 using a second plug 84 in a manner essentially the same as that described hereinabove. Indeed, referring back to FIG. 4B, the tines are replaced with terminal contacts as in 86 and are positioned such that when the flexible PCB 44 is folded, the terminal contacts 86 are exposed toward a front end 88 of the second plug 84. In order to interconnect the terminal contacts 32 of the first plug 14 with their respective terminal contacts 86 of the second plug 84, a series of conductive interconnecting bridging contacts, or bridging tines 90 are provided within the receptacle 18. As will now be apparent to a person of ordinary skill in the art, insertion of the first plug 14 into the first complementary socket 92 formed in the receptacle 18 and insertion of the second plug 84 into the second complementary socket 94 formed in the receptacle 18, the terminal contacts 32 of the first plug 14 are interconnected with their respective terminal contacts 86 of the second plug 84 through provision of the conductive interconnecting bridging tines 90.

Referring back to FIG. 5*b*, alternatively, and as discussed briefly above, the second flexible PCB 44 can be provided with a series slots as in 52 between each of the tines as in 54 and positioned within the connector receptacle (reference 18 on FIG. 1). Provision of the slots as in 52 allows the tines as in 54 to flex more independently, similar to conventional tines. As will now be apparent to a person of ordinary skill in the art, on insertion of the plug 14 into the receptacle 18, the plug terminal contacts 32 come into contact with a respective one of the receptacle tines as in 54, thereby completing the connection.

Figures 7A, 7B:
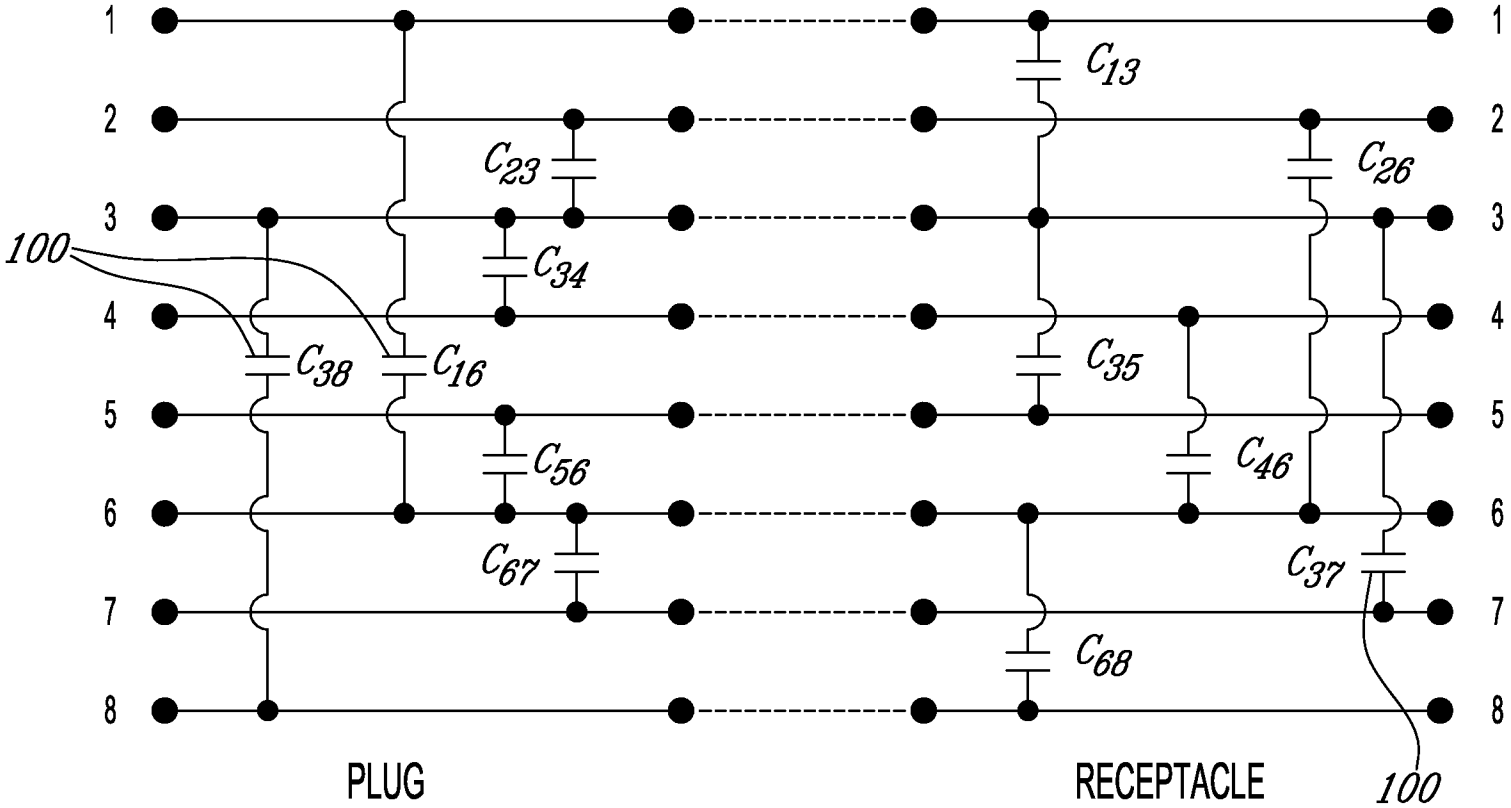
FIGS. 7*a* and 7*b* provide schematic diagrams of the compensation networks respectively in the plug and receptacle and in accordance with an illustrative embodiment of the present invention.

Referring to FIGS. 7*a* and 7*b*, different compensation schemes comprising the selection of different capacitive elements as in 100 can be implemented depending on the compensation being sought after. For example, in a first embodiment of compensation the plug and receptacle assembly are foreseen for use with respectively legacy (e.g. CAT6A) type receptacles and plugs. In other words, when a cable terminated with the plug of the present invention is inserted into a CAT6A receptacle, the assembly meets the cross-talk related performance specifications of a mated CAT6A connection. Similarly, when a CAT6A type cable/plug assembly is inserted into a receptacle according to the present invention, the assembly meets the cross-talk related performance specifications of a mated CAT6A connection. On the other hand, when a cable terminated by the plug of the present invention is inserted into a receptacle of the present invention, the assembly meets the cross-talk related specification of a mated CAT8 connection.

Still referring to FIGS. 7*a* and 7*b*, although the compensation schemes disclosed are shown as comprising discrete capacitances such as $C_{23}$ and $C_{67}$, a person of ordinary skill in the art will understand that these also include the small parasitic/intrinsic capacitances which might otherwise arise in such a plug or receptacle.

An advantage of the present configuration is that the compensating capacitances are introduced at substantially the same location as where the receptacle and the plug electrically interconnect. Indeed, referring to FIG. 7*c* when the plug is inserted into the receptacle socket the plug terminal contacts 32 come into contact with their respective tines as in 54 thereby providing a transmission path between the respective conductors of the cables attached to the plug and the receptacle. Introduction of the compensating capacitances at substantially the same location as where the receptacle and the plug electrically interconnect limits the amount of phase shift and the like which might occur and perturb the compensation.

Figure 7C:
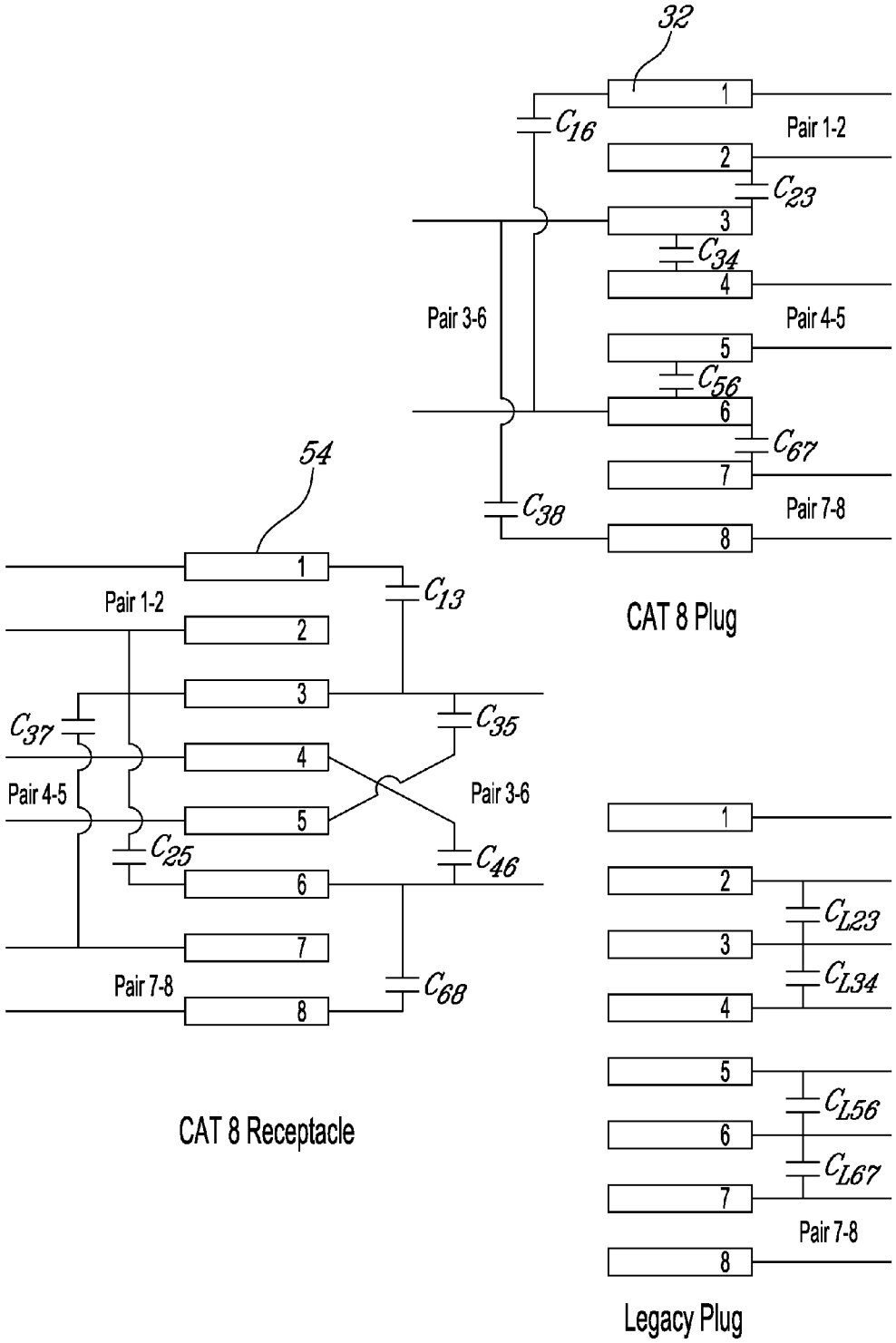
FIG. 7*c* provides a detailed schematic view of the interconnection between plug, legacy plug and receptacle in accordance with an illustrative embodiment of the present invention.

Still referring to FIG. 7*c*, between contacts terminating conductors of legacy plugs, for example, wire to wire coupling due to capacitance $C_{L23}$ and $C_{L67}$ occurs which at higher transmission speeds introduces cross talk into the transmission. To provide backward compatibility, it is necessary to take into account $C_{L23}$ and $C_{L67}$ within the compensation network of the receptacle of the present invention. As such, capacitances $C_{13}$ and $C_{26}$ are introduced to compensate for $C_{L23}$ and capacitances $C_{37}$ and $C_{68}$ are introduced to compensate for $C_{L67}$. This is in part done by positioning of traces 36, 56 opposite their respective terminal contacts 32 or tines 54 which both act as electrodes of their respective capacitances (reference 100 in FIGS. 7*a* and 7*b*) formed of the respective dielectric substrate 66, 76. The traces 36, 56 additionally provide the respective connections to the respective terminal contacts as required and according to the artwork as described hereinabove in FIGS. 5*a* and 5*b*.

Still referring to FIG. 7*c*, in order to ensure that the plug according to the present invention is compatible with the receptacle according to the present invention, capacitances $C_{23}$ and $C_{16}$ and $C_{67}$ and $C_{38}$ are introduced respectively in the plug to compensate for respectively capacitances $C_{13}$ and $C_{26}$ and $C_{37}$ and $C_{68}$ in the receptacle. A person of ordinary skill in the art will now understand that the plug of the present invention is also compatible with legacy receptacles for the same reasons.

Figure 7D:
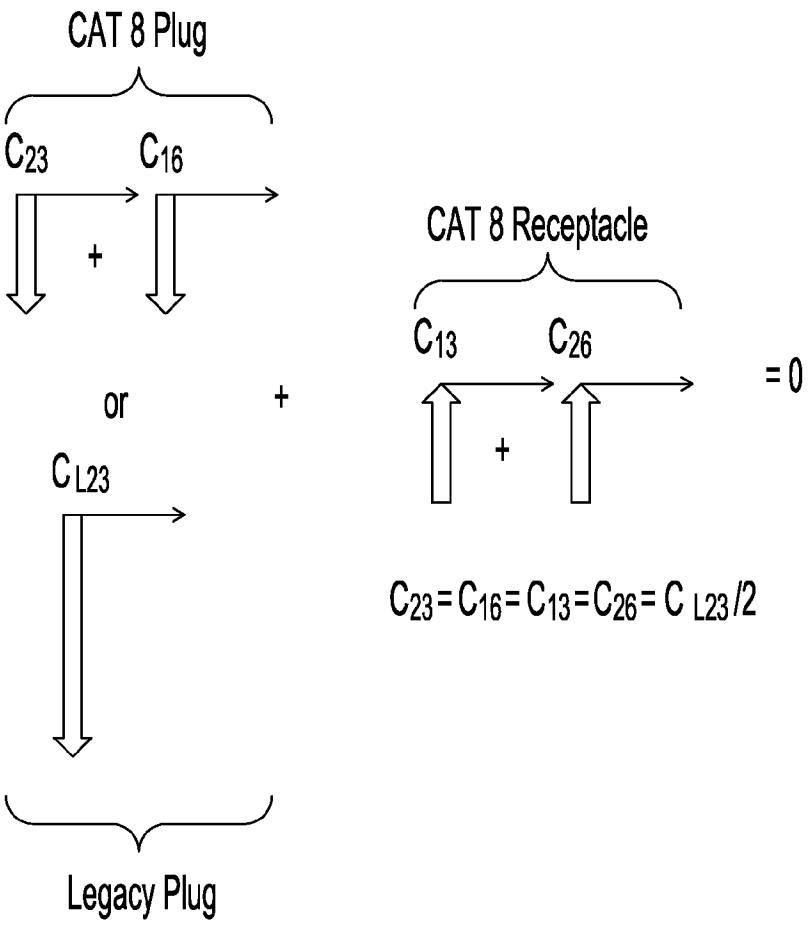
FIG. 7*d* provides a vector diagram of the coupling introduced by the compensating capacitances within the plug and receptacle of the present invention and a legacy plug.

Referring now to FIG. 7*d*, of note is that the coupling introduced by the single capacitances ($C_{L23}$) in the legacy plug is compensated for by two capacitances in the receptacle (respectively $C_{13}$ and $C_{26}$) of the present invention. For example, the coupling (and therefore the capacitance of) introduced by each of the capacitances could be about one half that of the legacy plug. In view of this, the compensating capacitances in the receptacle of the present invention would be selected such that $C_{23} \approx C_{16} \approx C_{13} \approx C_{26} \approx C_{L23}/2$. Given symmetry, the same would apply under these circumstances to $C_{37}$, $C_{38}$, $C_{67}$ and $C_{68}$. As will now be apparent to a person of ordinary skill in the art, compensating capacitances within the plug of the present invention would also be chosen in this manner under similar circumstances. One advantage of this particular configuration is that the coupling introduced by any one of these capacitances is less (in this case approximately half) of that of the legacy plug/receptacle. As such, at higher transmission frequencies the resulting crosstalk will typically be more linear, thereby allowing the plug/receptacles of the present invention to be used together at much higher frequencies, illustratively in the case disclosed up to at least 2 GHz.

Figure 8A:
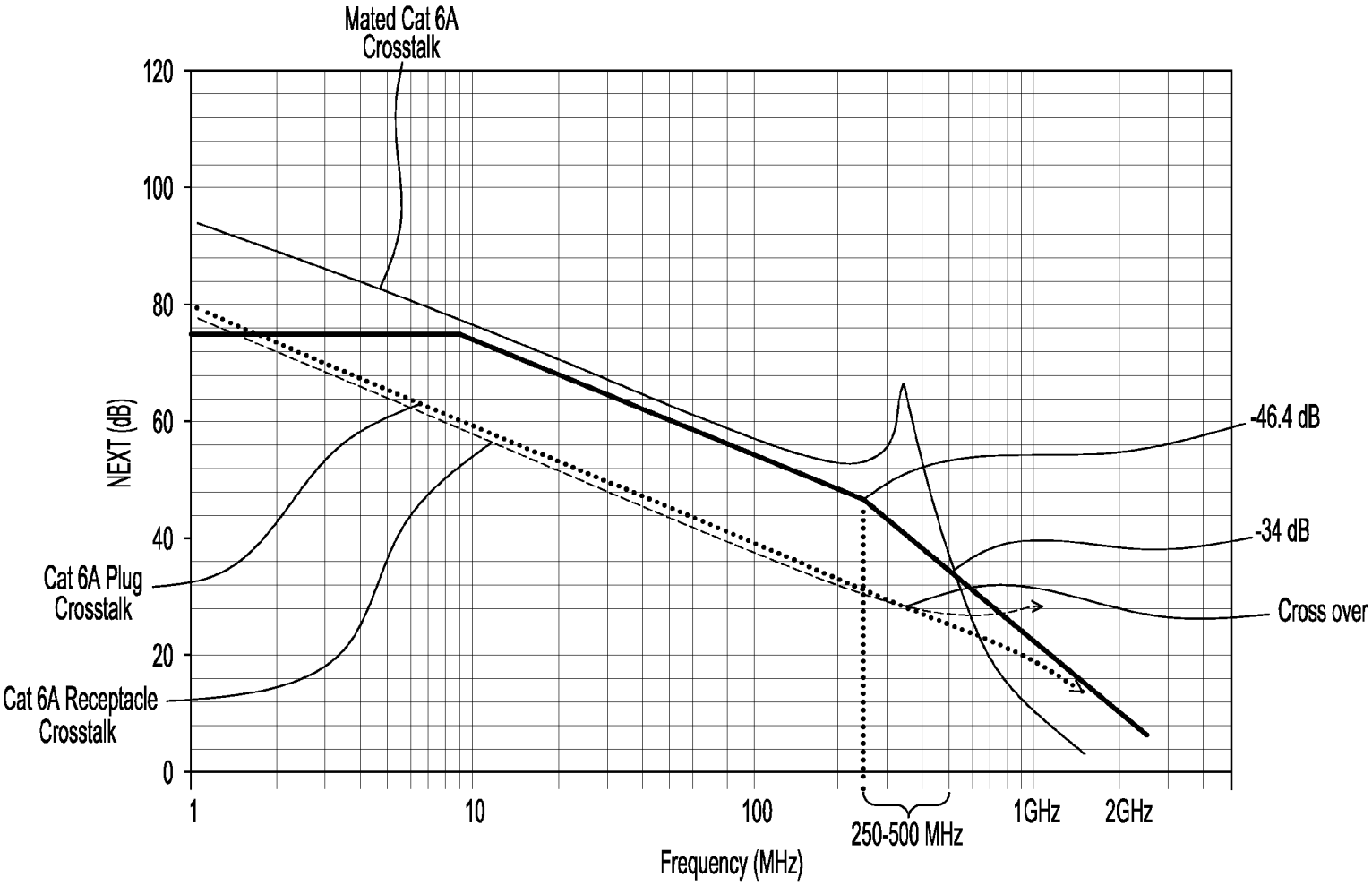
Fig. 8a (Prior Art)
FIG. 8*a* provides a chart of the crosstalk related frequency response of a prior art CAT6A plug, receptacle and mated interconnection.

Referring to FIG. 8*a*, as known in the art, typically CAT6A plugs and receptacles are of complementary design such that when mated (combined) they reduce crosstalk to within the specified levels across the frequencies of interest. In this regard, the crosstalk generated by the CAT6A plug is of similar levels to and generally 180° out of phase with the crosstalk generated by the CAT6A receptacle over a large portion of the range of frequencies 0 to 250 MHz. Typically crosstalk related to the CAT6A receptacle is somewhat more difficult to control frequencies above 250 MHz and as a result, the frequency response of the CAT6A receptacle tends to decay differently from that of the CAT6A plug at these higher frequencies. Illustratively, in one implementation the frequency response of the receptacle may be designed to cross over that of the plug towards the upper limit of the frequency range such that the combined crosstalk frequency response is maintained within specification limits.

Figure 8B:
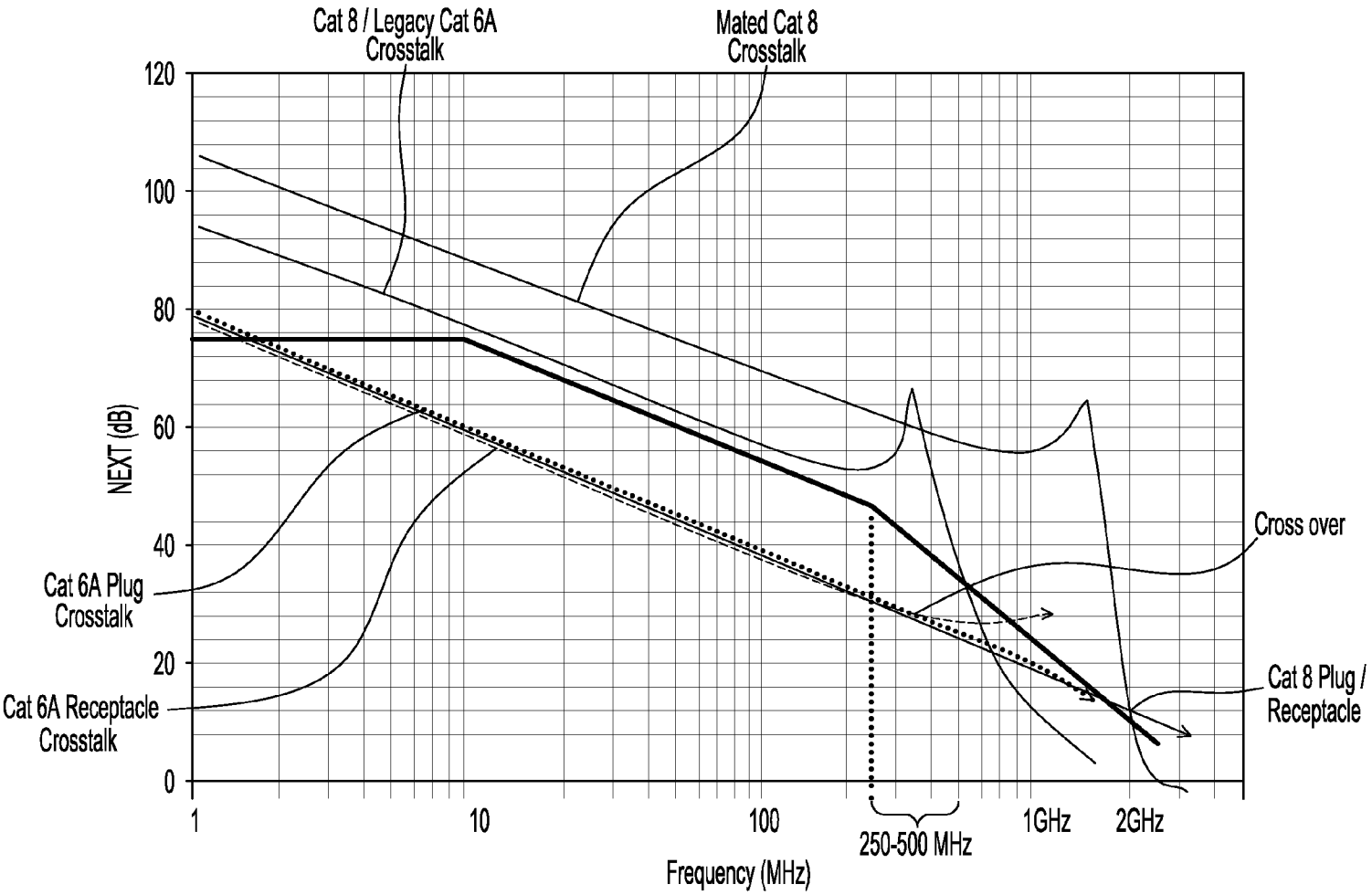
FIG. 8*b* provides a chart of the crosstalk related frequency response of a CAT8 plug/receptacle of the present invention, a CAT6A receptacle/plug and mated CAT8/CAT6A interconnection.

Referring now to FIG. 8*b*, the design of the CAT8 plug/receptacle allows for a controlled response to crosstalk over the frequencies of interest (0 to 500 MHz) and improved performance response to crosstalk up to at least 2 GHz. As will be seen below, in order to the ensure that the CAT8 plug is compatible with a CAT6A receptacle and vice versa the performance of CAT8 plug and CAT8 receptacle is modified over the frequencies of interest in order to match that of the CAT6A plug and CAT6A receptacle such that when mated, the CAT8/CAT6A assembly meets the performance requirements of the CAT6A specification. Additionally, the crosstalk related performance of the CAT8 plug and the CAT8 receptacle are matched such a mated CAT8 plug/receptacle assembly meets crosstalk related performance specifications up to at least 2 GHz.

Figure 8C:
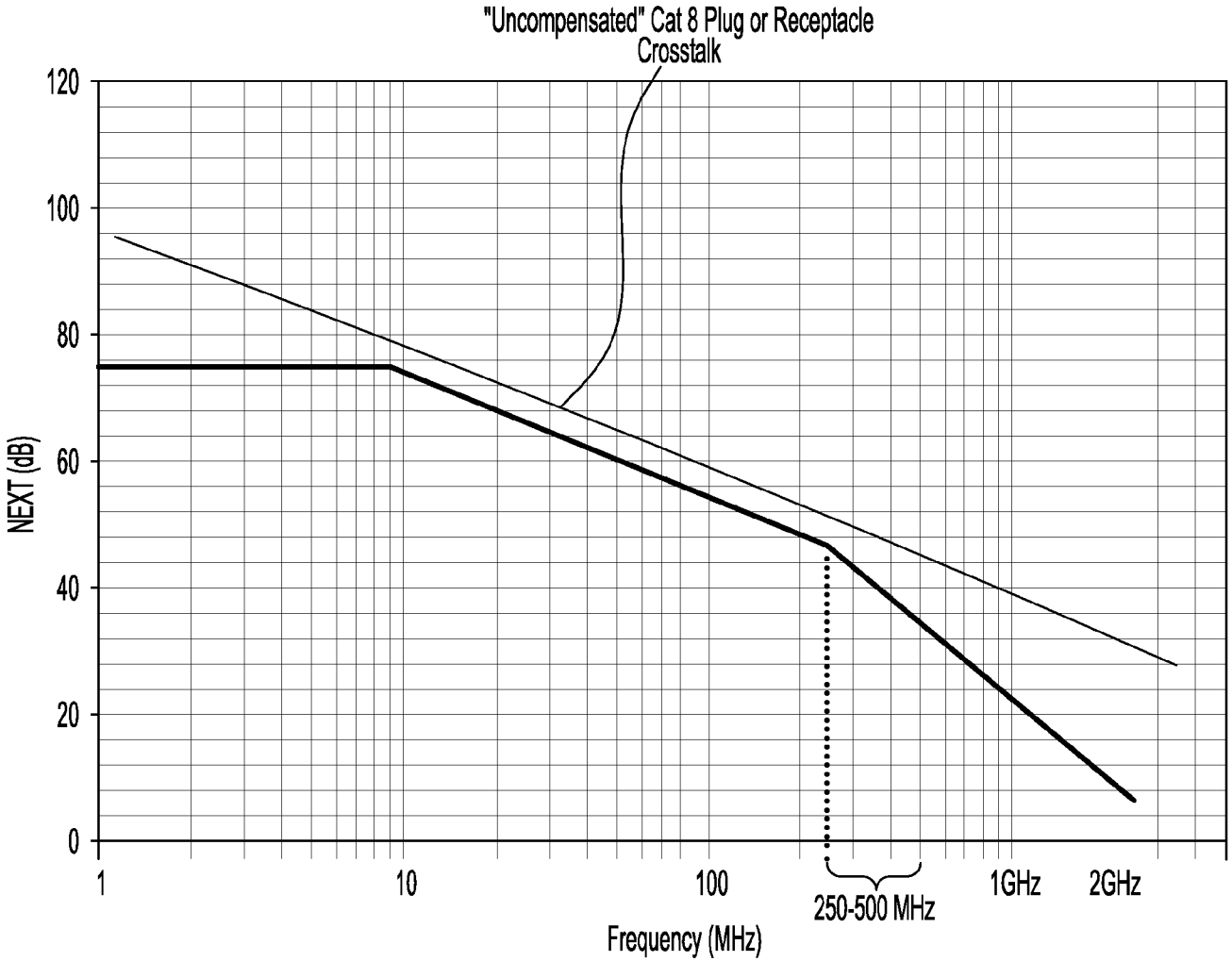
FIG. 8*c* provides a chart of the crosstalk related frequency response of a non-legacy plug/receptacle of the present invention.

Referring now to FIG. 8*c*, in an alternative embodiment the matched interconnector is uncompensated and therefore not legacy compatible. However, as the performance of the connector/plug does not have to be degraded in order to compensate for the lower crosstalk performance of the legacy CAT6A plug/connector, the performance of either the CAT8 plug or the CAT8 receptacle exceeds the crosstalk related requirements of the specification. As will now be apparent to a person of ordinary skill in the art, the mated connection must also exceed the crosstalk related requirements of the specification.

Figure 9:
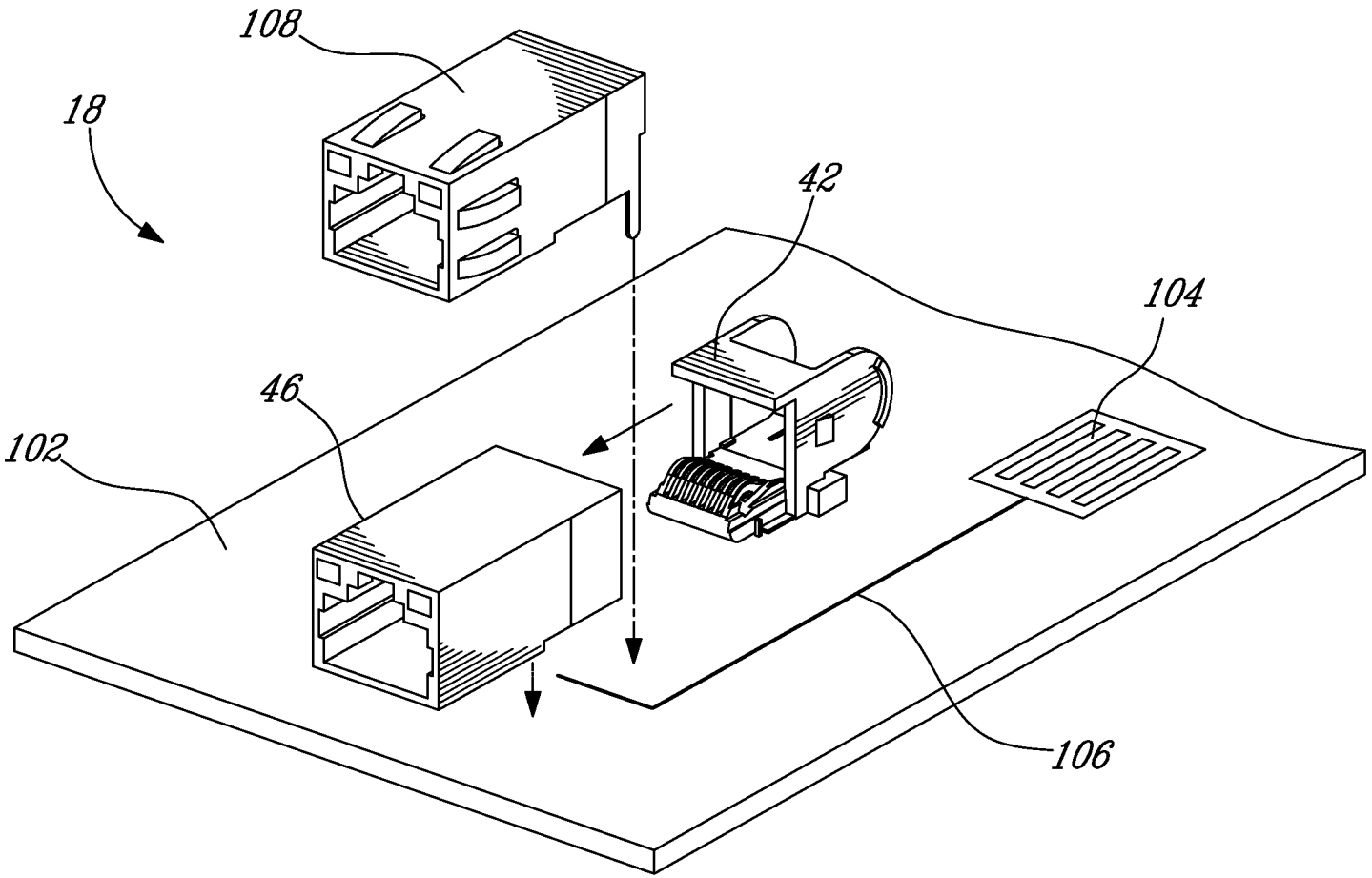
FIG. 9 provides a left front raised perspective view of a receptacle in accordance with an alternative embodiment of the present invention.

Referring now to FIG. 9, in an alternative embodiment of the receptacle 18, instead of terminating a cable the receptacle 18 with appropriate modifications can be mounted as an edge connector to a Printed Circuit Board (PCB) 102 for interconnection with electronics 104, such as microprocessors and the like, via conductive traces 106 etched on the surface of the PCB 102. In a particular embodiment a grounded metallic shield 108 covering the housing can be provided.

Although the present invention has been described hereinabove by way of specific embodiments thereof, it can be modified, without departing from the spirit and nature of the subject invention as defined in the appended claims.

We claim:

1. A cable connector assembly for use with a receptacle comprising a plurality of evenly spaced tines in a telecommunications system, the assembly comprising:

a cable comprising a plurality of pairs of conductors; and a RJ-45 style plug comprising a plug body for terminating said cable at a rear end thereof, a plurality evenly spaced terminal contacts exposed along a front of said plug body and arranged in parallel, and a printed circuit board assembly comprising a plurality of pairs of conductive traces electrically interconnecting each conductor of said pairs of conductors with respective ones of said terminal contacts, wherein a first pair of said pairs of conductors is electrically interconnected with respective ones of a center pair of said terminal contacts and a second of said pairs of conductors is electrically interconnected with respective ones of a second pair of said terminal contacts, said center pair of terminal contacts positioned between and immediately adjacent to each of said terminal contact of said second pair of terminal contacts;

wherein when said plug is inserted into the receptacle, each of said plurality of terminal contacts comes into electrical contact with a respective one of the plurality of tines along a contact region, wherein each of said terminal contacts comprises a first end and a second end and wherein each of said center pair of terminal contacts is electrically interconnected with a respective trace towards a first end and each of said second pair of terminal contacts is electrically interconnected with a respective trace towards a second end and such that a current flow between said plug and the receptacle in said center pair of terminal contacts is in a direction substantially opposite to that of said second pair of terminal contacts to achieve the preferred compensation.

2. The cable connector assembly of claim 1, wherein said plurality of terminal contacts comprises four pairs of contacts each comprising a first end and wherein a third pair and a fourth pair of said terminal contacts are positioned respectively on opposite sides of said center pair and second pair of terminal contacts and further wherein each of said terminal contacts is electrically interconnected towards said first end with a respective trace such that a current flow between said plug and the receptacle in said third and fourth pairs of terminal contacts is in substantially the same direction as said current flow in said center pair of terminal contacts.

3. The cable connector assembly of claim 2, wherein each of said third and fourth pairs of terminal contacts is electrically interconnected to its respective trace at said first end whereby said current flow between said plug and the receptacle in said third and fourth pairs of terminal contacts is in a direction substantially the same as that of said center pair of terminal contacts.

4. The cable connector assembly of claim 1, wherein said printed circuit board assembly comprises a flexible printed circuit board.

5. The cable connector assembly of claim 4, further comprising a support and wherein said flexible printed circuit board is bent to form a fold towards a middle thereof over said support such that a first end of said flexible printed circuit board lies opposite a second end of said flexible printed circuit board further wherein said traces come into electrical contact with their respective terminal contacts adjacent said fold.

* * * * *